US005980331A

United States Patent [19]

Matsushita et al.

[11] Patent Number: 5,980,331

[45] **Date of Patent: *Nov. 9, 1999**

[54] CONNECTOR ASSEMBLY

[75] Inventors: Yasuo Matsushita; Mitsuhiro Fujitani, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/893,882

[22] Filed: Jul. 11, 1997

[30] Foreign Application Priority Data

Jul. 11, 1996 [JP] Japan ..... 8-182457

[51] Int. Cl.[6] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 4,867,712 | 9/1989 | Kato et al. | 439/752 |
| 5,518,428 | 5/1996 | Onoda | 439/752 |

FOREIGN PATENT DOCUMENTS

| | | |
|---|---|---|
| 0670500 | 9/1995 | European Pat. Off. . |
| 0758806 | 2/1997 | European Pat. Off. . |
| 0795934 | 9/1997 | European Pat. Off. . |
| 0817322 | 1/1998 | European Pat. Off. . |
| 0881712 | 12/1998 | European Pat. Off. . |
| 2248350 | 4/1992 | United Kingdom . |

*Primary Examiner*—Gary F. Paumen

*Attorney, Agent, or Firm*—Jordan B. Bierman; Bierman, Muserlian and Lucas

[57] ABSTRACT

A connector assembly having a receiving housing, a fitting housing and a retainer. The fitting housing is inserted into the receiving housing and is held in engagement position by the retainer. However, if one or more electrical terminals, within cavities in the fitting housing, is not fully inserted into its locked position, the retainer is held in a temporary position wherein a portion thereof projects outwardly of the fitting housing. This portion engages the end face of the receiving housing. The end face is preferably perpendicular to the insertion direction or at an acute angle thereto. As a result, the receiving housing does not distort even if excessive insertion force is applied to the fitting housing and/or the retainer.

8 Claims, 6 Drawing Sheets

CONNECTOR ASSEMBLY

This Application claims the benefit of the priority of Japanese Application 8-182457, filed Jul. 11, 1996.

The present Invention is directed to a connector assembly comprising a receiving housing, a fitting housing, and a retainer. The construction is such that mis-assembly is substantially prevented.

BACKGROUND OF THE INVENTION

A typical prior art connector, with female terminal 3 only partially inserted into housing 1, is shown in FIG. 9. Housing 1 is adapted to fit inside of hood 5 which is attached to—or part of—the male housing (not shown). Retainer 2 carries a projection which bears against bevel 6 on the end face of hood 5. Lance 4, which serves to lock terminal 3 in position after it has been fully inserted in the cavity is affixed to—or integral with—housing 1. As shown in FIG. 9, it is not yet operative, since female terminal 3 has not been fully inserted into housing 1.

However, since the leading edge of hood 5 is provided with bevel 6, the Application of substantial insertion force will cause hood 5 to distort outwardly and permit housing 1 to fully enter hood 5, even though female terminal 3 has not been properly inserted into the cavity. This makes it very difficult or even impossible to determine, after assembly, whether terminal 3 is in its proper position. Moreover, since there are, as shown in FIG. 10, a plurality of cavities 7 (each containing terminal 3), it is possible that some terminals 3 will have been properly inserted, while one or more others are in the position shown in FIG. 9.

In FIG. 10, the female terminal in cavity 7 is incompletely inserted. As can be seen from the Figure, the left side of retainer 2 is fully inserted into housing 1, while the right side projects somewhat therefrom. Insertion pressure on housing 1 will cause it to distort hood 5 and enter completely therein. However, terminal 3 in cavity 7 will not make a proper electrical connection with the mating connector and, therefore, the assembly is defective. This cannot be determined by observation.

SUMMARY OF THE INVENTION

It is the object of the present Invention to provide a connector assembly wherein, if a terminal is not fully inserted into its corresponding cavity, the retainer and housing cannot be forced into the hood. As a result, visual inspection will readily determine whether all of the terminals are properly inserted into their respective cavities.

The connector assembly of the present Invention comprises a receiving housing, a fitting housing for insertion therein, and a retainer mounted on the fitting housing. The retainer has a temporary position, wherein an outer portion thereof projects radially outwardly. In this position, if assembly is attempted, the outer portion will abut the end face of the hood. There is a retraining section on the terminal which abuts the retainer when the terminal is not fully inserted and the retainer is in its temporary position. This prevents the retainer from moving from the temporary position to the engagement position, wherein the outer portion does not abut the end face. However, if the terminal is fully inserted, the restraining section is apart from the retainer and the retainer can be moved radially inward to permit ready insertion of the fitting housing and the retainer in the hood.

In a preferred form of the Invention, a radially inward bevel is provided (in the insertion direction) laterally between two end faces. This urges the retainer into its engagement position, provided that the terminals are fully inserted in their respective cavities.

In a further embodiment of the present Invention, a receiving cavity is formed on the end faces and a corresponding projection is on the retainer. In the event that the terminal is not fully inserted, the projection will fit into the receiving cavity and be retained therein. This provides added protection against the possibility of the hood being distorted by excess pressure in the insertion direction.

BRIEF DESCRIPTION OF THE DRAWINGS

In the accompanying drawings, constituting a part hereof and in which like reference characters indicate like part.

DETAILED DESCRIPTION OF THE INVENTION

Figure 1:
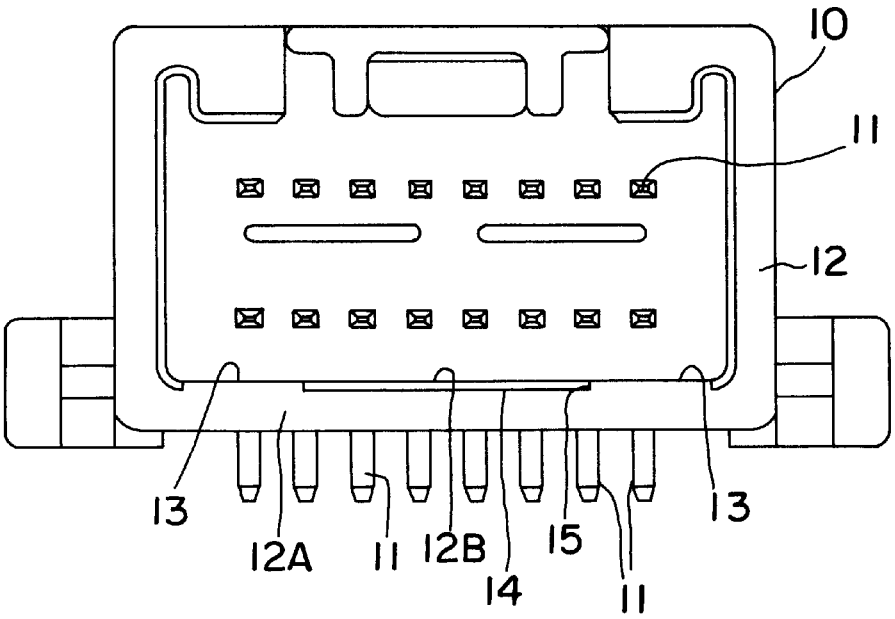
FIG. 1 is a front elevation of the receiving housing.

Receiving housing 10 is provided with hood 12 in which terminals 11 are located. Hood 12 has end surface 12A which comprises bevel 14 and end faces 13. Edge 15 is between bevel 14 and end face 13.

Figure 2:
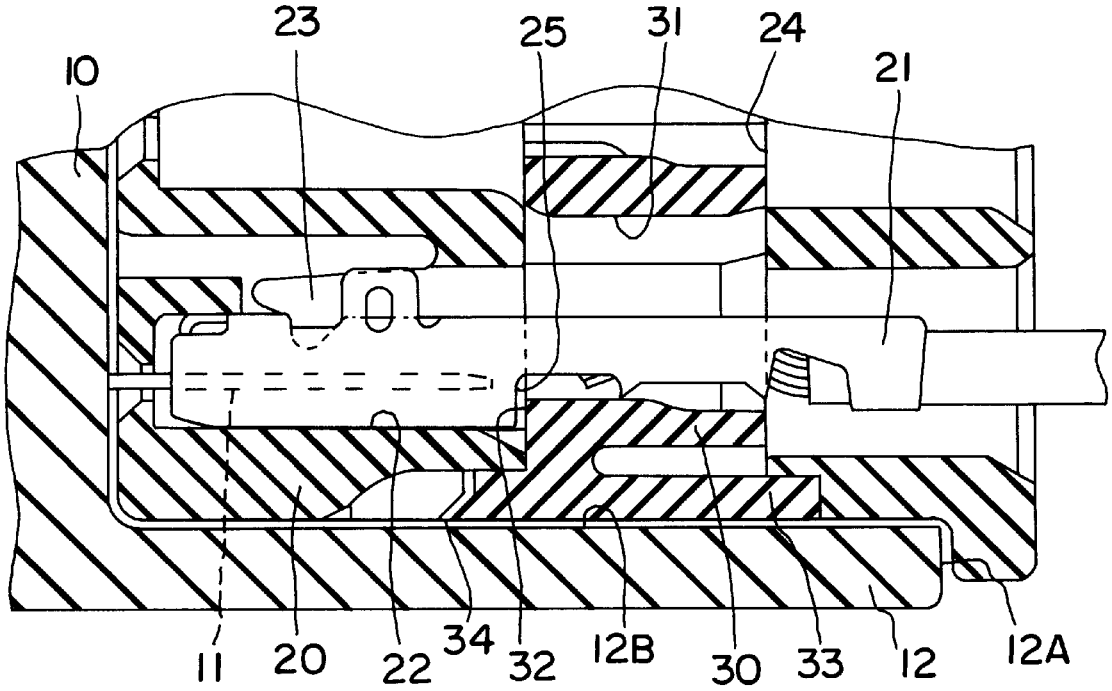
FIG. 2 is a longitudinal cross-section of the fitting housing with the terminal and the housing fully inserted.

Fitting housing 20 contains terminal 21 in terminal cavity 22. As can be seen in FIG. 2, terminal 21 is fully inserted in cavity 22 so that engagement section 32 of retainer 30 is immediately adjacent abutment section 25 of terminal 21, thus holding it in its locked or fully inserted position. Bottom plate 33 of retainer 30 is substantially coplanar with inner perimeter surface 12B of hood 12.

Retainer attachment hole 24 is provided in housing 20 to accommodate retainer 30 and the latter is provided with hole 31 to allow introduction of terminal 21. In the locked position, lance 23, due to its resilience, engages a complementary portion of terminal 21. Thus, terminal 21 is secured in its locked position both by lance 23 and the combination of engagement section 32 and abutment section 25.

Figure 3:
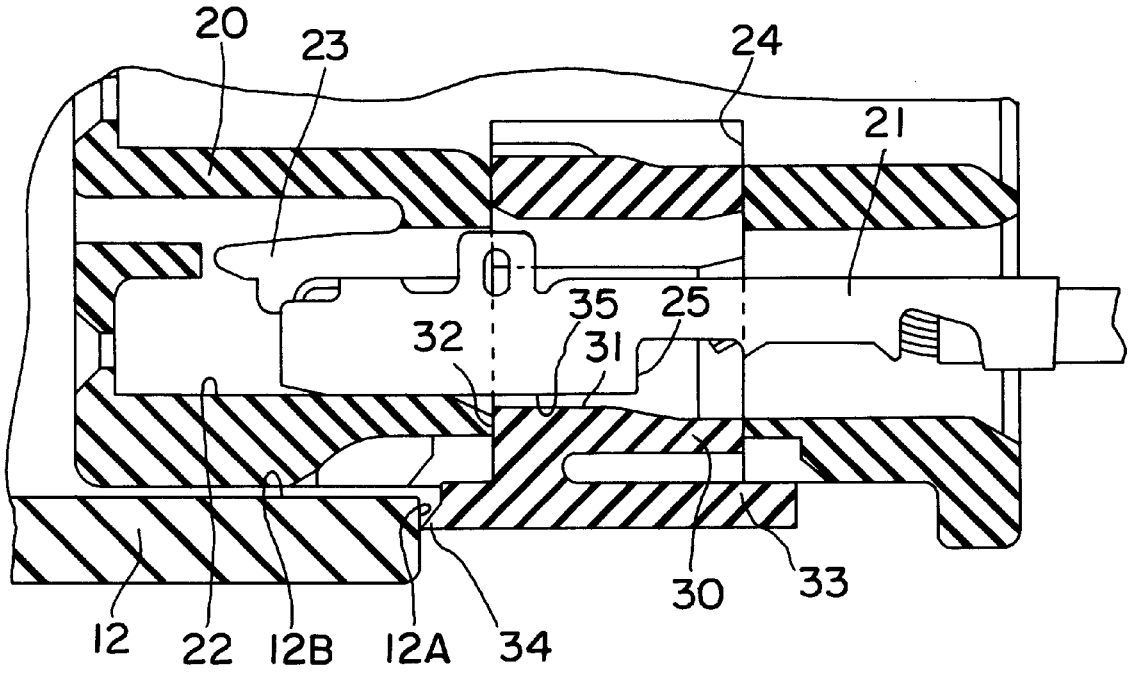
FIG. 3 is a view, similar to that of FIG. 2, wherein neither the terminal nor the fitting housing are fully inserted.
Figure 4:
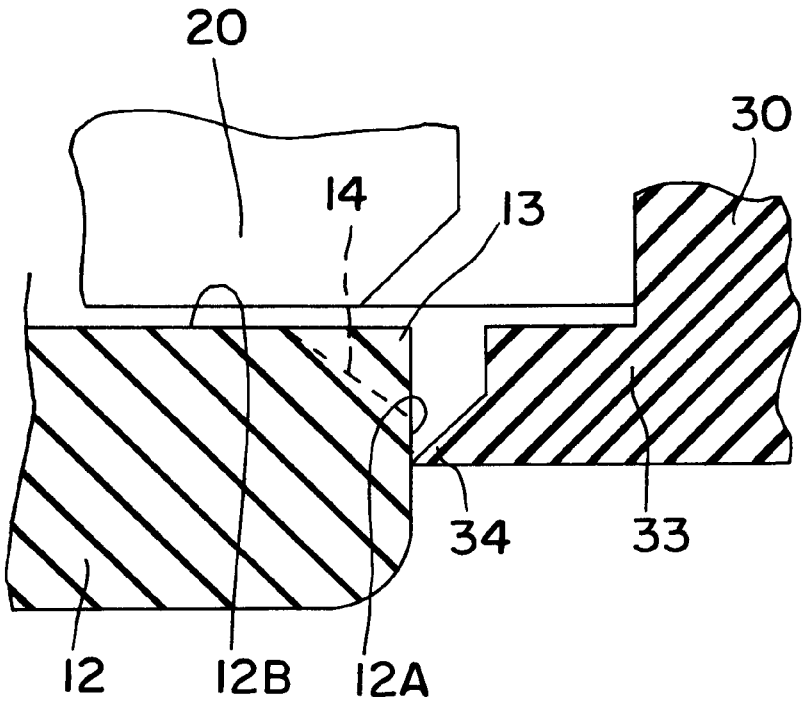
FIG. 4 is an enlarged fragmentary view, partly in section, showing the outer portion of the retainer in contact with the end face of the hood.

In FIGS. 3 and 4, terminal 21 is not fully inserted into cavity 22. Therefore, the outer portion of retainer 30 bears against end surface 12A of hood 12. Restraining section 35 of terminal 21 prevents retainer 30 from moving radially inward. Since end surface 12A is perpendicular to the insertion direction, hood 12 is not distorted and fitting housing 20 cannot be forced into hood 12.

Figure 5:
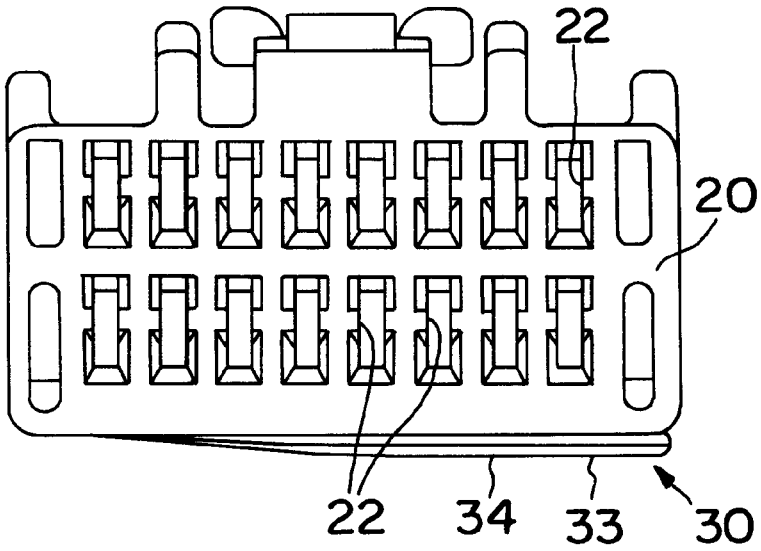
FIG. 5 is a plan view of a partially mis-assembled device of the present Invention.
Figure 6:
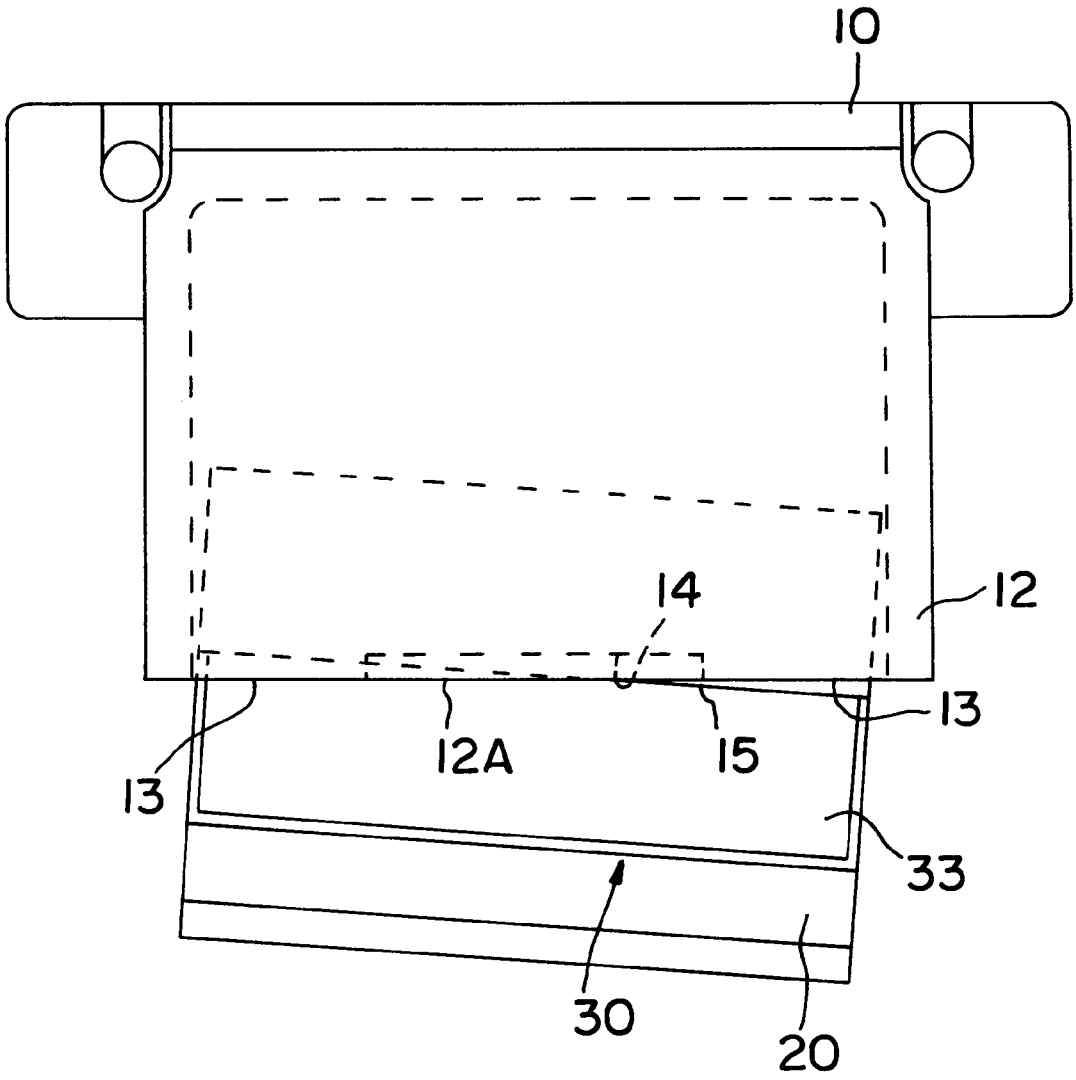
FIG. 6 is a bottom view of FIG. 5.

In FIGS. 5 and 6, the terminals in cavities 22 adjacent the right end of fitting housing 20 are in their partial positions.

As a result, projection 34 (FIG. 4) bears against end surface 12A of hood 12. This effectively prevents retainer 30 from assuming its engagement position and does not allow fitting housing 20 to be forced into hood 12 of receiving housing 10. The fact of mis-assembly can be readily observed and the defective assembly removed from the production line.

Figure 7:
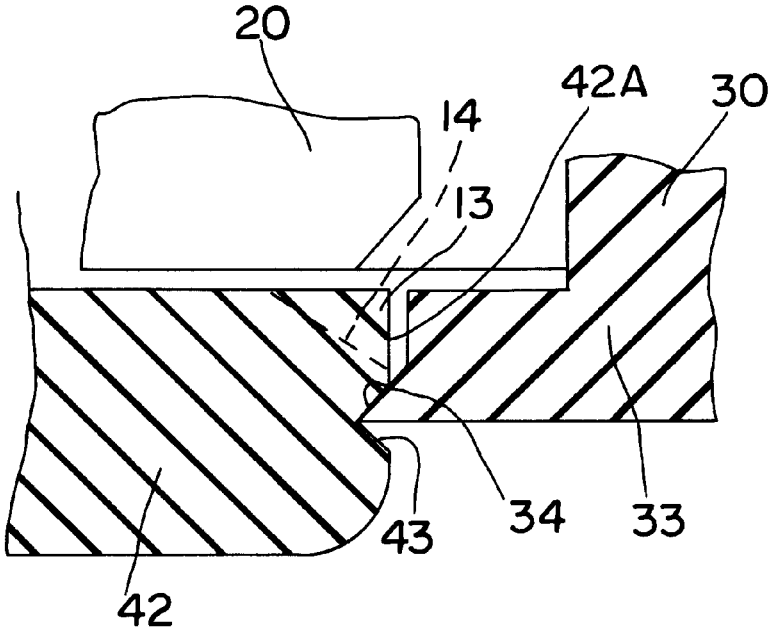
FIG. 7 is an enlarged view, similar to that of FIG. 4, showing a modification of the Invention.

A modification of the present Invention is shown in FIG. 7. As in the case of FIG. 4, the terminal is in its partial position and is not fully inserted into the terminal cavity. Projection 34 on base plate 33 of retainer 30 engages receiving cavity 43 in end surface 42A of hood 42. By virtue of the engagement of the projection in the cavity, retainer 42 and fitting housing 20 cannot be forced into hood 42.

Figure 8:
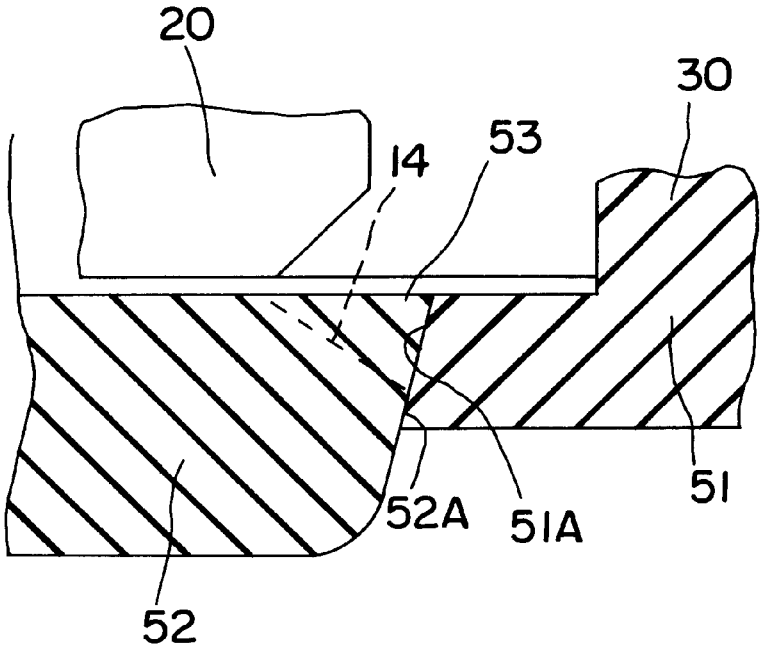
FIG. 8 is a view, similar to that of FIG. 7, showing a further modification of the Invention.
Figure 9:
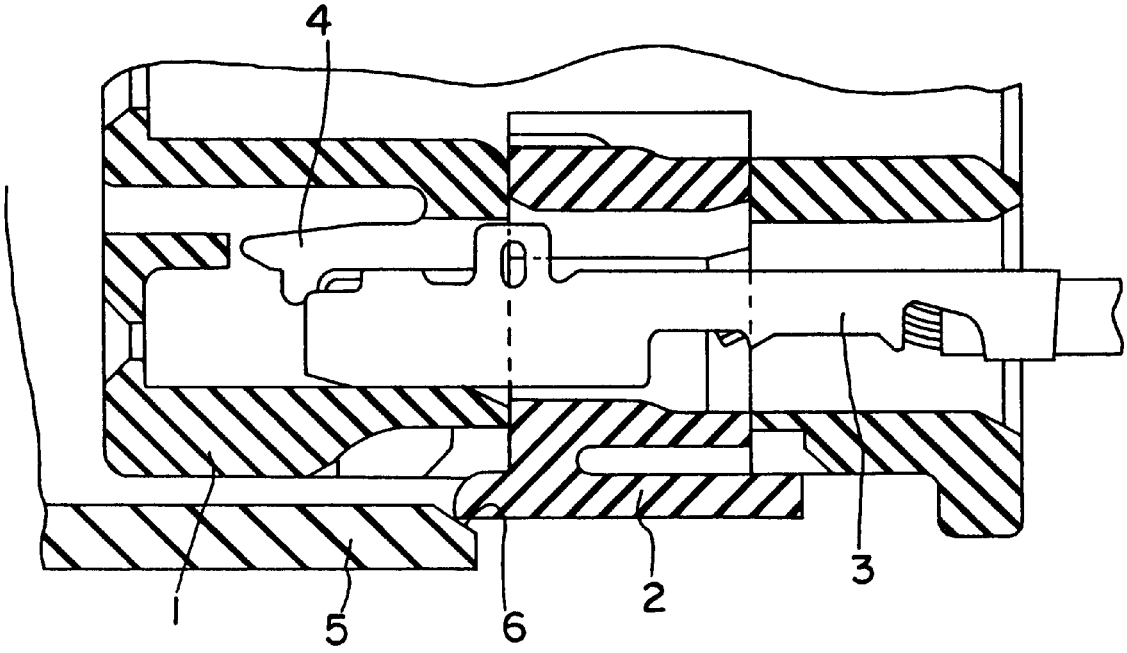
FIG. 9 PRIOR ART
FIG. 9 is a view, similar to that of FIG. 3, of a prior art device.
Figure 10:
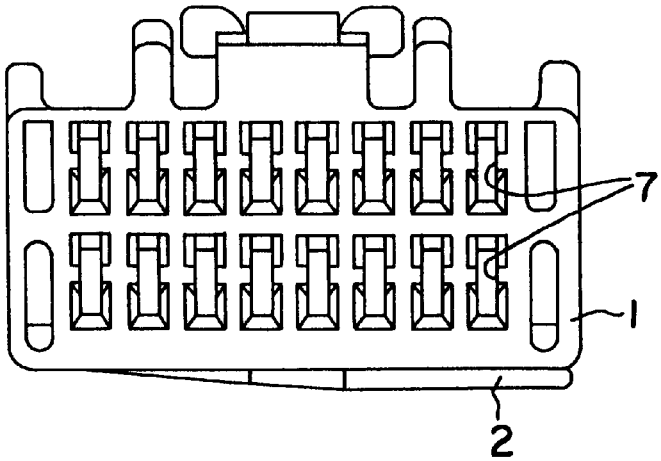
FIG. 10 PRIOR ART
FIG. 10 is a view, similar to that of FIG. 5, of the prior art device of FIG. 9.

Another modification is found in FIG. 8. In this case, end surface 52A is at an acute angle to the insertion direction of fitting housing 20. Leading face 51A on bottom plate 51 of retainer 30 is at the same angle as end surface 52A. Thus, hood 52 is urged radially inward by the insertion force, but it cannot move in that direction because of the presence of fitting housing 20. Therefore, it is virtually impossible to distort hood 52 and force retainer 30 into the hood.

Although only a limited number of specific embodiments of the present Invention have been expressly disclosed, such variations as would be apparent to the person of ordinary skill may be made without departing from the spirit thereof. The receiving housing has been described as having a hood into which the fitting housing is inserted. However, the hood is unnecessary; a suitably shaped receiving housing is also operable in accordance with the Invention.

The projection on the outer portion of the retainer can be eliminated provided that the end face of the hood (or receiving housing) is perpendicular or at an acute angle to the insertion path of the fitting housing. In this case, it is preferable that the leading face of the retainer match the end face on the hood. If desired, the bevel can be eliminated and the end face can consist entirely of the end surface. These and other changes may be made in the Invention without departing from the scope thereof. It is, therefore, to be broadly construed, and not to be limited except by the character of the claims appended hereto.

What we claim is:

1. A connector assembly comprising a receiving housing, a fitting housing adapted for insertion into said receiving housing in an insertion direction along a longitudinal insertion path, and a retainer, mounted on said fitting housing, having a temporary position, wherein an outer portion of said retainer projects radially outwardly of said fitting housing and is adapted to abut an end face of said receiving housing when said fitting housing is moved in said insertion direction, thereby to prevent insertion of said fitting housing into said receiving housing, said retainer having an engagement position, wherein said outer portion does not abut said end face, thereby permitting said insertion;

said fitting housing having at least one terminal cavity, an electrical terminal in said cavity, said terminal having a locked position, whereby said terminal is fully inserted in said cavity, and a partial position wherein said terminal is spaced apart from said locked position along a withdrawal path in a release direction opposite to said insertion direction;

a restraining section on said terminal which contacts said retainer when said terminal is in said partial position and said retainer is in said temporary position, thereby preventing said retainer from moving from said temporary position to said engagement position, said restraining section being out of contact with said retainer when said terminal is in said locked position;

a projection on said outer portion and a receiving cavity on said end face, said projection entering said receiving cavity when said terminal is in said partial position and said retainer is in said temporary position.

2. The connector assembly of claim 1 comprising an abutment section on said terminal, and engagement section abutting said abutment section when said terminal is in said locked position and said retainer is in said engagement position.

3. The connector assembly of claim 1 wherein said receiving housing is provided with a hood, said fitting housing being adapted for insertion into said housing and said end face being on said hood.

4. The connector assembly of claim 1 wherein said receiving housing has an end surface comprising said end face and a bevel, on said end surface, slanting radially inward in said insertion direction, whereby said retainer is urged radially inward as said fitting housing is moved in said insertion direction.

5. The connector assembly of claim 4 wherein said bevel is between two end faces in a transverse direction to said insertion path.

6. The connector assembly of claim 1 wherein said retainer has an angled surface which slants radially outwardly in said insertion direction and is adapted to contact said end face when said retainer is in said preliminary position whereby, as said retainer moves from said preliminary position to said engagement position, said retainer is urged radially inwardly.

7. The connector assembly of claim 4 wherein said retainer has an angled surface which is complementary to said bevel whereby, when said retainer moves from said preliminary position to said engagement position, said retainer is urged radially inwardly.

8. A connector assembly comprising a receiving housing, a fitting housing adapted for insertion into said receiving housing in an insertion direction along a longitudinal insertion path, and a retainer, mounted on said fitting housing, having a temporary position, wherein an outer portion of said retainer projects radially outwardly of said fitting housing and terminates in an abutment which is adapted to abut an end face of said receiving housing when said fitting housing is moved in said insertion direction, thereby to prevent insertion of said fitting housing into said receiving housing, said retainer having an engagement position, wherein said outer portion does not abut said end face, thereby permitting said insertion;

said fitting housing having at least one terminal cavity, an electrical terminal in said cavity, said terminal having a locked position, wherein said terminal is fully inserted in said cavity, and a partial position wherein said terminal is spaced apart from said locked position along a withdrawal path in a release direction opposite to said insertion direction;

a restraining section on said terminal which contacts said retainer when said terminal is in said partial position and said retainer is in said temporary position, thereby preventing said retainer from moving from said temporary position to said engagement position, said restraining section being out of contact with said retainer when said terminal is in said locked position, wherein said end face is perpendicular to, or flares outwardly in, said insertion direction.

* * * * *